US010724182B2

(12) United States Patent
Smith

(10) Patent No.: US 10,724,182 B2
(45) Date of Patent: Jul. 28, 2020

(54) LEVELING LIFTER FOR PRECAST CONCRETE SLAB

(71) Applicant: THE FORT MILLER CO., INC., Greenwich, NY (US)

(72) Inventor: Peter J. Smith, Gansevoort, NY (US)

(73) Assignee: The Fort Miller Co., Inc., Greenwich, NY (US)

( * ) Notice: Subject to any disclaimer, the term of this patent is extended or adjusted under 35 U.S.C. 154(b) by 0 days.

(21) Appl. No.: 16/164,593

(22) Filed: Oct. 18, 2018

(65) Prior Publication Data

US 2019/0048532 A1 Feb. 14, 2019

Related U.S. Application Data

(60) Provisional application No. 62/574,938, filed on Oct. 20, 2017.

(51) Int. Cl.

| | |
|---|---|
| ***E01C 11/00*** | (2006.01) |
| ***E01C 19/52*** | (2006.01) |
| ***E01C 3/00*** | (2006.01) |
| ***E01C 5/06*** | (2006.01) |
| ***E01C 23/10*** | (2006.01) |
| ***B66C 1/00*** | (2006.01) |
| ***E01C 5/00*** | (2006.01) |
| ***B66C 1/66*** | (2006.01) |

(52) U.S. Cl.

CPC ..... *E01C 11/00* (2013.01); *B66C 1/00* (2013.01); *B66C 1/666* (2013.01); *E01C 3/00* (2013.01); *E01C 5/001* (2013.01); *E01C 5/06* (2013.01); *E01C 19/52* (2013.01); *E01C 23/10* (2013.01)

(58) Field of Classification Search

CPC . E01C 11/00; E01C 3/00; E01C 5/001; E01C 5/06; E01C 19/52; E01C 23/10; B66C 1/00; B66C 1/666

See application file for complete search history.

(56) References Cited

U.S. PATENT DOCUMENTS 3,216,171 A * 11/1965 Jenkins ..... E04B 1/4121 52/127.3
3,431,012 A * 3/1969 Eriksson ..... B28B 23/005 294/89
3,590,538 A * 7/1971 Holt ..... E04B 1/4121 52/127.3
4,017,115 A * 4/1977 Holt ..... B66C 1/666 294/89
4,179,151 A * 12/1979 Tye ..... E04G 21/142 294/89
4,204,711 A * 5/1980 Lancelot, III ..... B66C 1/666 294/82.28

(Continued)

*Primary Examiner* — Abigail A Risic
(74) *Attorney, Agent, or Firm* — David B. Tingey; Bryant J. Keller; Kirton McConkie

(57) ABSTRACT

The described leveling lifter includes an engagement part embedded in a concrete slab, wherein the engagement part extends down to the base and contains a coupler component. The lifter may also include an actuator that is structured to engage the coupler within the concrete slab. The lifter also has a base configured under the engagement part. The base is configured to releasably couple to the concrete slab by projections set at a distance from one another on the base, the projections being configured to detach from the concrete slab in degrees upon engagement of the base by the actuator.

20 Claims, 4 Drawing Sheets

(56) References Cited

U.S. PATENT DOCUMENTS

| | | | | | |
|---|---|---|---|---|---|
| 4,325,575 | A * | 4/1982 | Holt | B66C 1/666 | 294/89 |
| 4,437,276 | A * | 3/1984 | Goldberg | B28B 7/0008 | 52/125.5 |
| 5,588,263 | A * | 12/1996 | Kelly | E04G 5/04 | 52/125.4 |
| 6,688,808 | B2 * | 2/2004 | Lee | E01C 5/005 | 404/34 |
| 9,347,232 | B1 * | 5/2016 | Francies, III | E04G 21/142 | |
| RE46,831 | E * | 5/2018 | Francies, III | | |
| 10,060,144 | B1 * | 8/2018 | Francies, III | E04G 21/10 | |
| 10,309,103 | B2 * | 6/2019 | Recker | E04B 5/04 | |
| 2013/0067849 | A1 * | 3/2013 | Espinosa | E04B 1/4121 | 52/699 |
| 2014/0026515 | A1 * | 1/2014 | Espinosa | E04B 1/4171 | 52/700 |
| 2014/0053475 | A1 * | 2/2014 | Siqueiros | E01C 23/10 | 52/125.1 |
| 2014/0150356 | A1 * | 6/2014 | Reed | E04B 1/4114 | 52/126.7 |
| 2015/0284915 | A1 * | 10/2015 | Sanders | E01C 5/06 | 404/41 |
| 2018/0274233 | A1 * | 9/2018 | Recker | E04B 5/04 | |

* cited by examiner

LEVELING LIFTER FOR PRECAST CONCRETE SLAB

CROSS REFERENCE TO RELATED APPLICATION

This application claims priority to U.S. Provisional patent application to Smith, entitled "LEVELING LIFTER FOR PRECAST CONCRETE SLAB," Ser. No. 62/574,938, filed Oct. 20, 2017, the disclosure of which is hereby incorporated entirely herein by reference.

BACKGROUND

Technical Field

This disclosure relates generally to precast concrete, and in particular to the transportation and leveling of precast concrete slabs.

State of the Art

Precast pavement slabs are pre-formed sections of concrete that are prefabricated offsite in controlled conditions and thereafter delivered to the job-site fully cured and ready to be installed in the desired positions. These slabs typically require the use of lifting inserts (four or more per slab) that enable contractors/manufactures to lift dried slabs from the form in which the wet concrete was initially poured, as well as to stack, ship and set the dried slabs in the field at the job-site.

One feature of precast pavement placement is that precast slabs must be supported at, or adjusted to, the proper grade and cross-slope before the slabs are finally grouted in place. There are some methods of achieving this objective. For example, one method involves creating an accurate subgrade surface before the slabs are positioned thereon so that the slabs thereby positioned reside in the correct location. Other methods include a leveling device used to enable contractors to adjust slabs to the proper grade even if the subgrade surface is not graded accurately. The fabrication of these leveling devices can, in many cases, be costly.

There is thus a need in the relative industry to design and implement a new and improved leveling device.

SUMMARY

The present disclosure relates to precast concrete, and in particular to the transportation and leveling in place of precast concrete slabs.

An aspect of the present disclosure includes a leveling lifter for a precast concrete slab comprising: a coupler body embedded within an opening in a precast concrete slab, wherein the opening is open to a top and a bottom surface of the slab; a base releasably coupled to the bottom surface of the slab and under the opening; and projections positioned on the base at a predetermined distance from the opening and configured to extend upward from the base substantially orthogonally into the slab.

Another aspect of the present disclosure includes a leveling lifter for a precast concrete slab, the leveling lifter comprising: a body embedded in a concrete slab, the body having a coupler; an actuator configured to engage the coupler within the slab; and a base releasably coupled to the concrete slab by projections set at a distance from one another on the base, the projections being configured to detach from the concrete slab in degrees upon engagement of the base by the actuator, wherein the body extends from a position within the slab and contacts the base.

Another aspect of the present disclosure includes a method of lifting and leveling a precast concrete slab, the method comprising: embedding a threaded coupler within an opening of the concrete slab, wherein the opening runs through the entire depth of the slab; releasably coupling a base to the concrete slab below the opening; providing at least two protrusions on the base, the protrusions being set at a distance from one another, the protrusions being configured to extend upwardly and substantially orthogonally from the base; threading the actuator down into the opening and engaging the threaded coupler; and operating the actuator to generate a downward force against the plate to forcibly detach the plate from the bottom of the precast concrete slab and to simultaneously generate a corresponding uplifting force to forcibly lift the concrete slab up and away from the plate.

The foregoing and other features, advantages, and construction of the present disclosure will be more readily apparent and fully appreciated from the following more detailed description of the particular embodiments, taken in conjunction with the accompanying drawings.

BRIEF DESCRIPTION OF THE DRAWINGS

Some of the embodiments will be described in detail, with reference to the following figures, wherein like designations denote like members.

DETAILED DESCRIPTION OF EMBODIMENTS

A detailed description of the hereinafter described embodiments of the disclosed apparatus and method are presented herein by way of exemplification and not limitation with reference to the Figures listed above. Although certain embodiments are shown and described in detail, it should be understood that various changes and modifications may be made without departing from the scope of the appended claims. The scope of the present disclosure will in no way be limited to the number of constituting components, the materials thereof, the shapes thereof, the relative arrangement thereof, etc., and are disclosed simply as an example of embodiments of the present disclosure.

As a preface to the detailed description, it should be noted that, as used in this specification and the appended claims, the singular forms "a", "an" and "the" include plural referents, unless the context clearly dictates otherwise.

Figure 3:
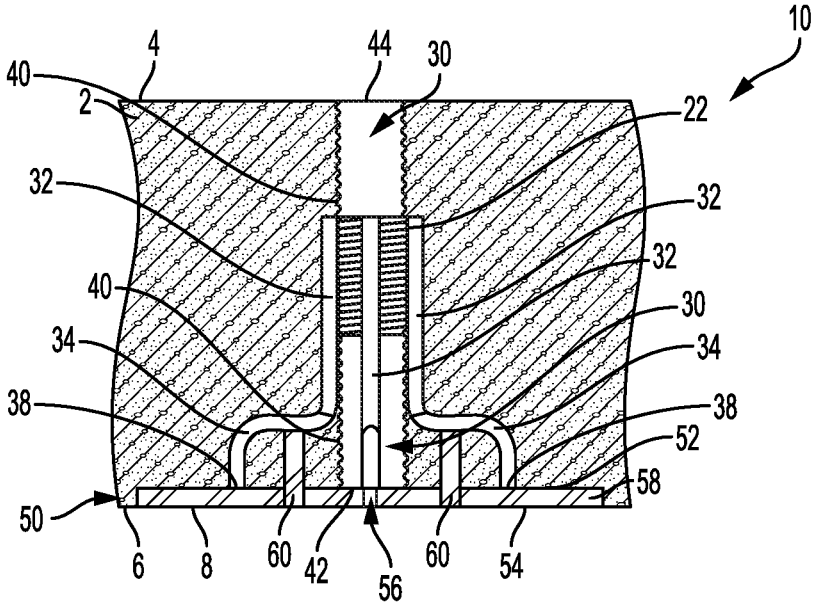
FIG. 3 is a cross-sectional elevation view of an embodiment of a leveling lifter for a precast concrete slab, in accordance with the present disclosure.

Referring to the drawings, FIG. 3 depicts an embodiment of a leveling lifter 10 for a precast concrete pavement slab. Embodiments of the leveling lifter 10 may comprise various structural and functional components, such as, for example, an engagement part 20 and a base 50, that complement one another to provide the unique functionality and performance of the leveling lifter 10, the structure and function of which will be described in greater detail herein.

Figure 1:
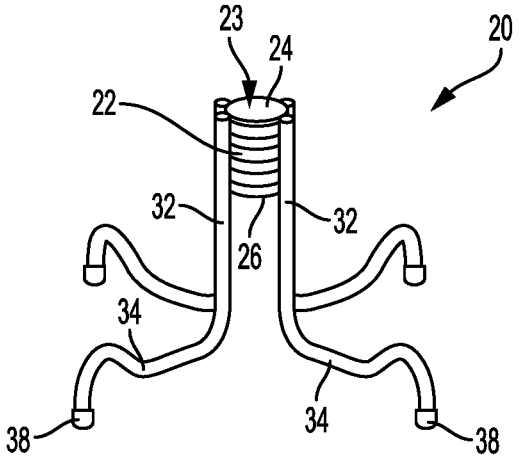
FIG. 1 is a perspective view of an embodiment of a component of a leveling lifter for a precast concrete slab, in accordance with the present disclosure.

With reference now to FIG. 1, embodiments of the leveling lifter 10 may comprise an engagement part 20. The engagement part 20 may comprise a body 22 and one or more legs 32 coupled at some point and in some way to the body 22.

The body 22 may comprise a longitudinal length between a first end 24 and a second end 26. The body 22 may define a hollow bore 23 running through the entire length of the body 22 between the first and second ends 24 and 26, such that the bore 23 is open-ended on either side (i.e., top and bottom). The body 22 may be a coupler of sorts having a size and shape to correspond to and communicate with an actuator 46, such as, for example, a lift bail 41, a casting bolt 43, and/or a leveling bolt 45, each of which is to be described in greater detail herein. For example, the body 22 may have a portion thereof that is a threaded coupler having a thread pattern that corresponds to an associated thread pattern of the actuator 46. Accordingly, when the actuator 46 and the body 22 are to be releasably coupled with one another, the actuator 46 may be brought into close proximity with the body 22 and the thread pattern of the actuator 46 may be received by and engage at least the threaded coupler portion of the body 22. Once threadably engaged in this manner, the actuator 46 and the body 22 may function as a single unit and the force exerted on the actuator 46 may correspondingly be exerted on and supported by the body 22. For example, a lifting force may be exerted on the actuator 46 to lift the precast concrete slab 2 off of the ground 7 or other surface (i.e., top surface 8) upon which the precast concrete slab 2 rests. The actuator 46 may transmit this upward lifting force to the body 22, by physical contact or engagement therewith, and the body 22 may likewise transmit this upward lifting force to the concrete slab 2, by physical contact or engagement therewith, to thereby lift the concrete slab 2, which will be described in greater detail herein.

Embodiments of the leveling lifter 10 may comprise the body 22 further comprising the legs 32 coupled thereto, such as, for example, on the exterior surface of the body 22. The legs 32 may comprise a portion 34 thereof that extends transversely from the body 22. In other words, the portion 34 of the leg 32 may be configured to extend in a non-parallel manner with respect to the longitudinal axis of the body 22. In this way, at least the portion 34 of each leg 32 extends outwardly and away from the body 22. The legs 32 may each further comprise a foot 38 on a distal end of the leg 32. The foot 38 may be configured to contact a plate 58 of the base 50, to be described in greater detail herein.

Embodiments of the engagement part 20 may comprise at least four legs 32 extending from the body 22, one leg on each "side" of the body 22, such that the four legs 23 are spaced at equidistant lengths from one another about the exterior surface of the body 22. The legs 32 may be fixedly coupled to the body 22, such as by press-fit, welding, or other fastening means. The legs 32 may be configured to be integral with the body 22, such as the legs 32 and body 22 being manufactured together as a single component. The legs 32 may be configured to have a portion thereof extend in a parallel manner with respect to the longitudinal axis of the body 22. However, as mentioned above, at least the portion 34 of the leg 32 extends substantially outwardly from the body 22 in a non-parallel or transverse orientation with respect to the longitudinal axis of the body 22. In this way, once the part 20 is inserted within a precast slab of concrete 2 and the concrete 2 dries about the part 20 (i.e., with the part 20 embedded therein), at least the portion 34 functions to extend away from the body 22 to engage a larger portion of the concrete 2 to secure the part 20 within the concrete 2 and prevent the part 20 from releasing out of the concrete 2 as force is applied to the part 20.

With reference now to FIGS. 1 and 3, embodiments of the engagement part 20 may comprise the body 22 being a coil thread or coil coupler having internal threads and a diameter about a 1¼ inch wide. The body 22 may also have a length of about 1 to 2 inches, as depicted in FIG. 1. Embodiments of the engagement part 20 may further comprise a duct, pipe, or tube-like element 40 that may be configured to extend above and/or below the body 22 in a parallel manner with the longitudinal length of the body 22, as depicted in FIG. 3. The element 40 may be configured to have a diameter substantially similar to that of the body 22 and/or the bore 23 and to be substantially axially aligned with the axis of the body 22. The element 40 may be configured to couple, either fixedly or releasably, to the body 22 and remain in relative position therewith while the precast concrete slab 2 is formed therearound. The element 40 may be configured to extend from the body 22 for a distance below the body 22, such that a first distal end 42 of the element 40 may contact or otherwise physically engage the base 50. In like manner, element 40 may also be configured to extend from the body 22 for a distance above the body 22, such that a second distal end 44 of the element 40 may extend at least to the top of, or out of the top of, the precast concrete slab 2. The purpose of the element 40 extending from the body 22 and contacting the base 50 and/or extending to or out of the top of the slab 2 is to create an opening 30 from the top of the concrete slab 2 to the base 50, with the body 22 being exposed within, or at least accessible within, the opening 30.

Embodiments of the engagement part 20 may further comprise the element 40 being configured to have a rough, ribbed, grooved, wavy, corrugated, coarse, textured, and/or otherwise uneven outer exterior surface to interact with and engage the concrete slab 2. Alternatively, the element 40 may be configured with a completely smooth outer exterior surface. Further in the alternative, the element 40 may be configured to have a textured outer surface above the body 22, but a smooth outer surface below the body 22.

Figure 6:
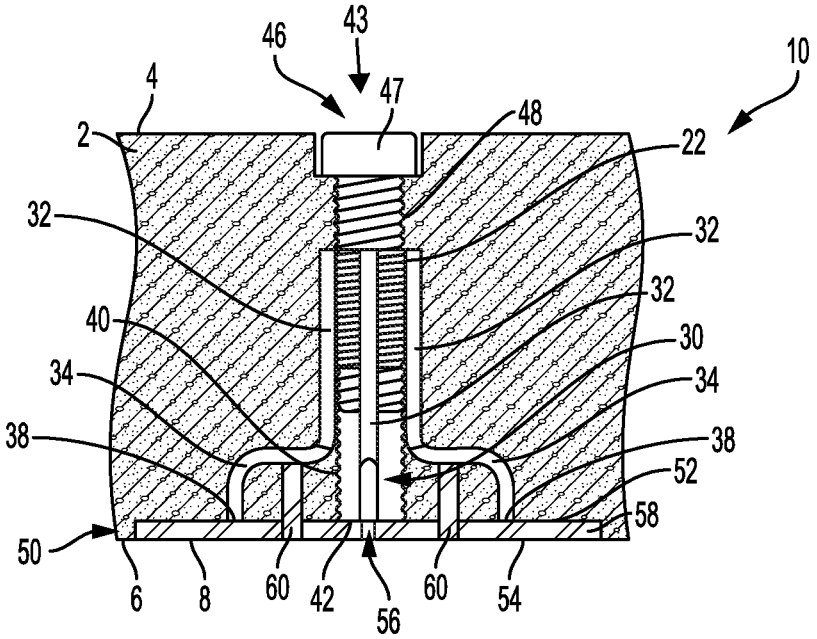
FIG. 6 is a cross-sectional elevation view of an embodiment of a leveling lifter for a precast concrete slab, in accordance with the present disclosure.

Alternatively, embodiments of the engagement part 20 may further comprise the tube-like element 40 being configured to extend only below the body 22. In such cases, the element 40 may be configured to couple to and extend from the body 22 with the first distal end 42 contacting or otherwise physically engaging the base 50. The element 40 may be configured to have a smooth outer surface below the body 22. Moreover, with the element 40 extending only below the body 22 and down to the base 50, an actuator 46, such as the casting bolt 43 depicted in FIG. 6, may be positioned with the body 22 to engage the body 22 and thereby remain in place above the body 22 until purposefully removed. The casting bolt 43 may remain in place while the precast concrete slab 2 is initially cast or poured over the leveling lifter 10. The casting bolt 43 may thereby serve the purpose of preventing the concrete that forms the slab 2 from filling the opening 30 above the body 22. In other words, with the casting bolt 43 in place while the concrete slab 2 is poured and dried, the casting bolt may prevent the slab 2 from closing off access to the body 22. For example, once the slab 2 is dried, the casting bolt 43 may be removed from engagement with the slab 2 and the body 22, such as by mechanical or rotational force. The casting bolt 43 may be a bolt having a threaded shaft 48 and a head 47. Rotational force may be applied to the head 47 to break the bond between the slab 2 and the shaft 48. The casting bolt 43 can then be entirely removed from the slab 2 and the body 22 to expose the opening 30 above the body 22.

Embodiments of the engagement part 20 may further comprise the body 22 being configured to receive therein and retain the casting bolt 43, with the casting bolt 43 having a length at least equal to or greater than the depth of the to-be-poured slab 2. In other words, prior to the precast slab 2 being formed around the leveling lifter 10, the casting bolt 43 may be inserted into and engage the body 22 such that the casting bolt 43 contacts the base 50 on its one end (i.e., distal bolt end) and extends above the top of the to-be-poured precast slab 2 on the other end (i.e., bolt head end). The distal end of the casting bolt 43 that contacts the base 50 may have a diameter that is smaller than the diameter of the remaining portion of the shaft 48. The smaller diameter of the distal end may function to engage the base 50 to maintain the base 50 in place during casting of the precast concrete slab 2. For example, in some embodiments, the smaller diameter of the distal end may partially or fully engage at least a portion of the hole 56 in the base 50. With the casting bolt 43 in contact with the base 50, in this way, the use of the element 40 is unnecessary to create the opening 30, because the size, dimension, and shape of the casting bolt 43 function to define and create the opening 30 in the slab 2. For example, once the concrete of the slab 2 is dried and the casting bolt 43 is completely removed from the precast slab 2, the body 22 is left exposed and accessible within the opening 30.

Embodiments of the engagement part 20 may further comprise the body 22 being configured to have a length somewhere between about 7 and 10½ inches, inclusive, from the first end 24 to the second end 26. For example, instead of utilizing the element 40, embodiments of the engagement part 20 may comprise the body 22 itself being configured to extend from the top of the precast concrete slab 2 down to the base 50 without the need for the element 40. Thus, while the body 22 itself may extend for the complete depth of the concrete slab 2 from the top surface 4 thereof to the bottom surface 6 thereof, the body 22 may comprise at least a portion thereof that is threaded or that can otherwise functionally engage the one or more actuators 46, as described herein. In this way, the body 22 itself defines and maintains the opening 30 from the top of the slab 2 to the base 50.

Embodiments of the engagement part 20 with the body 22 extending through the entire depth of the slab 2 may further comprise the body 22 being configured to have a rough, ribbed, grooved, wavy, corrugated, coarse, textured, and/or otherwise uneven outer exterior surface to interact with and engage the concrete slab 2. Alternatively, the body 22 may be configured with a completely smooth outer exterior surface. Further in the alternative, the body 22 may be configured to have a textured outer surface above the portion thereof that engages the one or more actuators 46, but a smooth outer surface below the portion thereof that engages the one or more actuators 46.

Alternatively, embodiments of the engagement part 20 may comprise the body 22 being configured to extend only partially through the depth of the slab 2. For example, similarly to the element 40 extending only below the body 22, the body 22 itself may be configured to extend from a position internal within the slab 2 down to the base 50, or stated another way, upward for a designated distance from the base 50 to an internal position within the slab 2 (i.e., a distance less than the full depth of the slab 2). In these embodiments, the element 40 may not be needed, because the body 22 functions to define the opening 30 within the slab 2 and the one or more actuators 46 coupled to a portion of the body 22 (i.e., a threaded portion, for example) may define the opening above the body 22. In particular, and as described above, the actuator 46, such as the casting bolt 43, can be positioned with the internal threaded portion of the body 22 to engage the body 22 and thereby remain in place above the body 22 until purposefully removed. The casting bolt 43 may remain in place above the body 22 while the precast concrete slab 2 is poured over the leveling lifter 10. The casting bolt 43 may thereby serve the purpose of preventing the slab 2 from filling the opening 30 above the body 22. In other words, with the casting bolt 43 in place while the concrete slab 2 is poured and dried, the casting bolt 43 may prevent the slab 2 from closing off access to the body 22. Then, like above, once the slab 2 is dried, the casting bolt 43 may be removed from engagement with the slab 2 and the body 22, such as by mechanical or rotational force. The casting bolt 43 may be a bolt having a threaded shaft 48 and a head 47. Rotational force may be applied to the head 47 to break the bond between the slab 2 and the shaft 48. The casting bolt 43 can then be entirely removed from the slab 2 and the body 22 to expose the opening 30 above the body 22.

Figure 2:
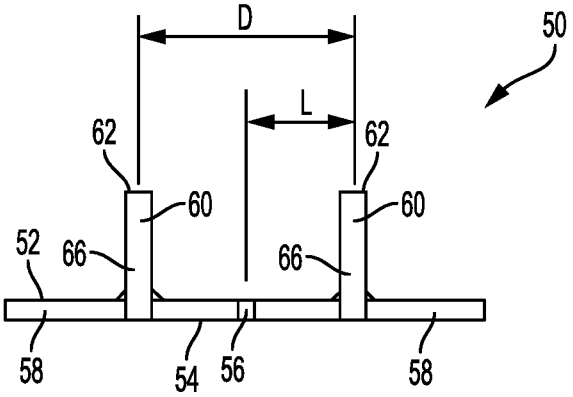
FIG. 2 is a cross-sectional elevation view of an embodiment of a component of a leveling lifter for a precast concrete slab, in accordance with the present disclosure.

With reference now to FIG. 2, embodiments of the leveling lifter 10 may comprise a base 50. The base 50 may comprise a plate 58 having a top surface 52 and a bottom surface 54. The plate 58 may define substantially flat surfaces 52 and 54, with the surface 52 configured to abut (or set within) the precast concrete slab 2 upon forming the slab 2, and the surface 54 configured to align with the bottom surface 6 of the precast slab 2 to thereby rest upon a top surface 8 of the bedding or ground 7 when the concrete slab 2 is set in place in a roadway. The plate 58 may further comprise a hole 56 that is positioned in substantially the center of the plate 58. The hole 56 may be used to orient or position the plate 58 with respect to the engagement part 20. The plate 58 may be of, for example, circular, square, or rectangular shape when viewed from above. The plate 58 may have a thickness of, for example, between ¼ and 1 inches, inclusive. The plate 58 may be comprised of metal or other rigid materials, such as any combination of metals, such as zinc, magnesium, titanium, copper, iron, steel, carbon steel, alloy steel, tool steel, stainless steel, aluminum, any combination thereof, and/or other like materials, in addition to alloys, such as aluminum alloy, titanium alloy, magnesium alloy, copper alloy, any combination thereof, and/or other like materials.

Embodiments of the base 50 may further comprise the plate 58 having one or more projections 60 thereon. The projections 60 may extend upward and away from the surface 52 of the plate 58, such that the projections 60 are substantially orthogonal to the plate 58. The projections 60 may be configured as bumps, ridges, raised portions, studs, elevations, protrusions, bulges, lumps, knobs, or other type of protuberances. The projections 60 may be configured to hold the base 50 against the bottom surface 6 of the slab 2, or vice versa, upon and after formation of the slab 2. For example, when cast, the concrete may be configured to flow about and settle around the projections 60, such that when dried the concrete slab 2 grips the projections 60 (or vice versa) to hold the plate 58 in place with respect to the slab 2. Alternatively, embodiments of the base 50 may further comprise the plate 58 having depressions (not depicted). The depressions may be holes, gaps, dents, breaks, slits, channels, indentations, dips, troughs, concavities, voids, cracks, cavities, or other type of hollows or openings in the surface 52 thereof. The depressions may be configured to hold the base 50 against the bottom surface 6 of the slab 2 upon and after formation of the slab 2. For example, when cast, the concrete may be configured to flow into and settle within the depressions, such that when dried the concrete slab 2 grips the depressions (or vice versa) to hold the plate 58 in place with respect to the slab 2.

Embodiments of the base 50 may further comprise the projections 60 being positioned randomly across the top surface 52 of the plate 58. Alternatively, the projections may be positioned at a predetermined distance L from the center of the plate 58, or from the hole 56. The base 50 may be configured with one or more projections 60 positioned at the distance L. Embodiments of the base 50 may be configured with at least two (2) projections 60 positioned at the predetermined distance L from the hole 56 on opposite sides of the hole 56. The predetermined distance L may be substantially equivalent to the height of the projections 60, or vice versa. Alternatively, the predetermined distance L may be half the distance between the outer edge of the plate 58 and the hole 56. Embodiments of the base 50 may further comprise the projections 60 being positioned at a predetermined distance from one another.

Embodiments of the base 50 may further comprise the projections 60 being fixedly coupled to the plate 58. The projections 60 may be bolted, welded, glued, screwed, press-fitted, or otherwise fastened onto the plate 58. For example, holes may be drilled into the plate 58 and the projections may be inserted therein and bolted, welded, glued or otherwise fastened to the plate 58. Or, alternatively the projections 60 may be fastened to the top surface 52 of the plate 58. In some embodiments, the projections 60 may be integrally formed with the plate 58. The projections 60 may be comprised of metal, metal composites, metal alloys, and the like. For example, the projections 60 may be made of steel and/or steel alloys. These metal projections may be affixed to the base 50 by means associated with adhering metal to metal, such as those listed above, for example. Alternatively, the projections 60 may be comprised of plastic (s), plastic composites, or other like plastic polymer-based materials. For example, the projections 60 may be comprised of polypropylene, polycarbonate, ABS, or the like. These plastic-based projections may be affixed to the base 50 by means associated with adhering plastics to metal, such as those listed above, for example.

Embodiments of the base 50 may further comprise the projections 60 being configured as cylinders extending substantially orthogonally upward from the plate 58 about 2 to 2½ inches, as depicted in FIG. 2, with the distal end 62 being a substantially flat surface, even substantially parallel with the top surface 52 of the plate 58. The cylindrical projections may have a diameter of about ½ inch. The cylindrical projections 60 having a shape and size, as described, such as a length of about 2 to 2½ inches and a diameter of about ½ inch, can be advantageous to not only the adherence of the plate 50 to the slab 2, but also the subsequent dislodging of the plate 50 from the slab 2 and the leveling of the slab 2 within the existing roadway, to be discussed in greater detail herein.

The cylindrical projections 60 may have an outer exterior surface 66 that may be configured to be substantially smooth. The smooth surface 66 may be advantageous to assist in the release of the projections 60 from the concrete slab 2 when, and if, desired. Moreover, the smooth exterior surface 66 may establish and maintain a slidable engagement between the projections 60 and the concrete slab 2, once the initial grip of the slab 2 on the projections 60 is broken, which is described in greater detail herein. In the alternative, the exterior surface 66 of the projections 60 may be configured to have a rough, ribbed, grooved, wavy, corrugated, coarse, textured, and/or otherwise uneven surface to interact with and engage the concrete slab 2. The rough or uneven exterior surface 66 may be beneficial to better grip the slab 2 that is formed around the projections 60. For example, a roughened or uneven exterior surface 66 would be beneficial to keep the base 50 in place on the slab 2 during shipping, handling, and placing of the slab 2 in the roadway.

Moreover, embodiments of the cylindrical projections 60 may comprise the projections 60 being made of plastic or other brittle material. In such embodiments, the projections 60 may be adhered to the base 50, such as by a countersunk head that mates with the base 50 and allows the shaft of the projections 60 to extend upward and away from the base 50 with the exterior surface 66 thereby exposed above the base 50 and ready for the slab 2 to be poured over the top thereof. The plastic-based projections 60 may also have a portion thereof that has a thinner diameter than the remaining portions. This thinner portion may be a first diameter and configured on the shaft of the projections 60 above the base 50 and approximate the top surface 52 of the plate 58. In this way, the projections 60 may have a first diameter positioned at or just above the plate 58 and a second diameter that extends from the end of the first diameter to the distal end of the projection 60, with the first diameter being smaller than the second diameter. The thinner diameter, or first diameter, may be configured to break or otherwise detach from the rest of the projection 60 under force that is applied to the base 50 to lift the slab 2 up and away from the base 50, as described in greater detail herein. When the projection 60 breaks at the first diameter, a portion of the projection 60 remains embedded in the slab 2 (due in part to the rough or uneven exterior surface 66) and the remaining portion of the projection (i.e., the head) remains connected to the base 50. Stated another way, the plastic-based projection 60 having a rough exterior surface 66 and first and second diameters may be considered a break-away pin or break-away projection.

Figure 4:
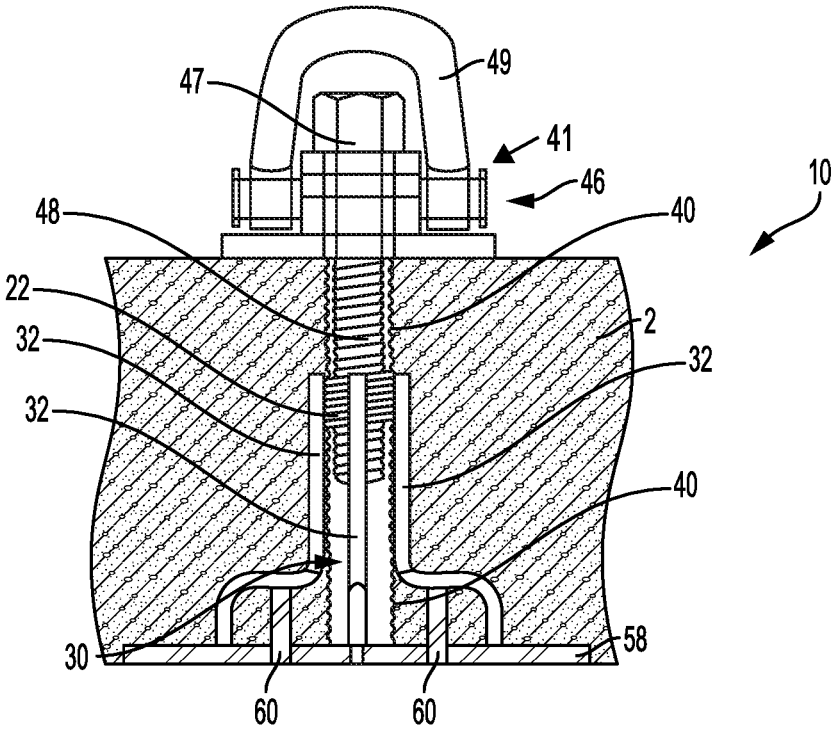
FIG. 4 is a cross-sectional elevation view of an embodiment of a leveling lifter for a precast concrete slab, in accordance with the present disclosure.

With reference now to FIG. 4, embodiments of the leveling lifter 10 may comprise the engagement member 20 being positioned on the base 50. For example, the engagement member 20 may be positioned over the base plate 58 such that the feet 38 contact the top surface of the plate 58 and the axis of the body 22 substantially aligns with the axis of the hole 56. Embodiments of the lifter 10 may further comprise receptacles (not depicted) on or in the top surface 52 of the plate 58. The receptacles may be configured to receive the feet 38 of the engagement member 20 such that the engagement member 20 does not slide or shift with respect to the plate 58 once the engagement member 20 is placed thereon.

Embodiments of the leveling lifter 10 may comprise the lifter 10 being configured within a precast concrete slab 2. For example, the lifter 10 may be placed in a precast form into which concrete will be poured. The lifter 10 may be comprised of the plate 50 and the engagement member 20 being in contact with one another, as described herein. Once positioned, the concrete may be poured into the form and over the lifter 10. The concrete can then be left to dry to form the slab 2. The precast slab 2 may be configured with one or more leveling lifters 10 embedded therein. Once dry, the precast concrete slab 2 may need to be transported to an existing roadway location in need of repair or replacement.

The precast concrete slab 2 may be lifted through the engagement of one or more actuators 46 and the engagement part 20. For example, the actuator 46, such as the lift bail 41 depicted in FIG. 4, may be inserted into the opening 30 until the lift bail 41 engages the body 22. In the case of the lift bail 41 having a threaded shaft 48, the threaded shaft 48 may be rotated to engage the corresponding internal threads of the body 22. This threaded engagement may serve to hold the lift bail 41 in place with the body 22, as depicted. Also, the lift bail 41 may be configured with a hoist coupler 49 on the upper portions thereof that may be configured to have coupled thereto a crane or other mechanical hoisting mechanism. The hoisting mechanism may thus exert lifting force on the hoist coupler 49 to thereby exert force on the engagement part 20 to thereby exert force on the slab 2 to lift the precast slab 2 out of its place. In addition, once physically transported to the desired location, lifting force may again be exerted on the hoist coupler 49 to thereby lift and insert the precast slab 2 into position within an existing roadway, a portion of which will be or has been removed to make room for and receive the precast slab 2.

Figure 5:
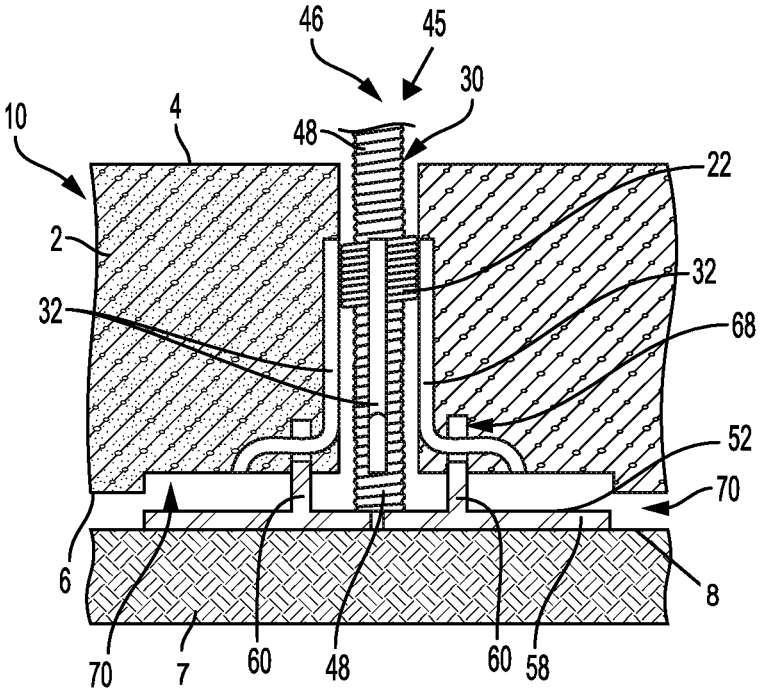
FIG. 5 is a cross-sectional elevation view of an embodiment of a leveling lifter for a precast concrete slab, in accordance with the present disclosure.

With reference now to FIG. 5, embodiments of the leveling lifter 10 may comprise the requisite structure, as described herein, that provides the functional ability to lift and level the precast concrete slab 2 in place in the roadway. The lifter 10 may be configured to adjust the level of the top surface 4 of the slab 2 to match or align with the neighboring top surface of the existing roadway. For example, with the precast slab 2 positioned in the roadway, the actuator 46, such as the leveling bolt 45 depicted in FIG. 5, may be inserted within the opening 30 to engage the engagement member 20 and, in particular, the body 22. The leveling bolt 45 may be a bolt having a threaded shaft 48 that corresponds to the internal threads of the body 22. With the leveling bolt 45 in threaded engagement with the body 22, the leveling bolt 45 may be axially advanced through the body 22 within the opening 30 until the distal end of the leveling bolt 45 contacts the base 50.

With the leveling bolt 45 in contact with the base 50, the force generated from continued operation or actuation of the leveling bolt 45 (i.e., rotational input translates to axial force) causes the leveling bolt 45 to engage the base 50 within the opening 30 and thereby cause the engagement part 20 to begin to rise upward along the shaft 48 of the leveling bolt 45, thus forcing the engagement part 20 away from the base 50. Because the base 50 is positioned on the top surface 8 of the bedding or ground 7 on which the slab 2 is set, the downward force acting thereon by the leveling bolt 45 does not cause the base 50 to move further downward into the ground 7. Instead, the force created by operation of the leveling bolt 45 and the contact between the leveling bolt 45 and the base 50 causes the engagement part 20 to rise up along the shaft 48 of the leveling bolt 45. And, because the engagement part 20 is rigidly fixed, or otherwise embedded, within the concrete slab 2, as the engagement part 20 advances upward along the shaft 48 of the leveling bolt 45 the entire concrete slab 2 breaks away from the base 50 and begins to rise with the engagement part 20, leaving a gap 70 therebetween and causing the base 50 to be pushed down against the top surface 8 of the ground 7 upon which the slab 2 is set.

With the leveling bolt 45 functioning to push apart the engagement part 20 from the base 50, the projections 60 on the base 50 are configured to dislodge or detach from their initial position within precast concrete slab 2 and remain with the base 50. More specifically, as the engagement part 20 begins to be distanced from the base 50, the initial concrete engagement between the projections 60 and the concrete slab 2 is broken and the projections 60 begin to slide out of their self-created cavity 68, as depicted in FIG. 5. The concrete slab 2 can continue to be lifted up from the top surface 8 for a distance as great as the leveling bolt 45 is long. However, in most cases, the precast slab 2 need only be lifted or adjusted by less than an inch, but there may be conditions under which the slab 2 may need to be lifted or adjusted by more than an inch.

Several advantages are obtained by the use of the projections 60 on the base 50 as the concrete slab 2 is lifted upward by the operation of the leveling bolt 45 on the engagement part 20. The projections 60 being positioned at a distance from the hole 56 (i.e., the opening 30, the shaft 48, etc.) assists in the detachment of the base 50 from the concrete slab 2 as the concrete slab moves upward and off the base 50. With the projections 60 positioned at a distance from the hole 56, the points of contact between the base 50 and the slab 2 are separated from one another, thus facilitating a more even and consistent detachment of the base 50 from the slab 2. In other words, multiple points of contact separated from one another at a distance allows the detachment forces acting on the base 50 to be distributed more evenly over the base 50. In addition to the above, the relatively small shape of the projections 60, such as a relatively small diameter and/or a relatively small length, allows the projections 60 to break away or detach rather easily from the precast slab 2 without damaging the slab 2. Further thereto, with the projections 60 spaced apart from the opening 30, the rigidity of the precast concrete slab 2 is not compromised, as there is enough concrete between the opening 30 and the cavities 68 to maintain sufficient strength so as not to break or fracture during removal of the base 50 therefrom. Furthermore, the length of the projections 60 is advantageous, because the length of the projections 60 usually allows the projections 60 to remain engaged within the cavities 68 in a slidable engagement with the cavities 68. Such an engagement assists with the retaining of the plate 58 under the leveling bolt 45, because the plate 58 cannot slide outside of its positioning with the projections 60 still in contact with the cavities 68. Further thereto, having the projections 60 be separate from one another, as well as placing distance between the projections 60 themselves, prevents the plate 58 from spinning or rotating in its place due to the rotational input of the leveling bolt 45 as it operates on the body 22.

Once the precast concrete slab 2 has been lifted to the desired height within the existing roadway, additional bedding material (such as concrete, grout, expansive urethane foam material, or fast-drying concrete may be injected or otherwise inserted between the precast slab 2 and the roadway, as well as under the precast slab 2 and the ground 7 on which the plate 50 rests. Once the additional bedding material has dried, the leveling bolt 45 may be removed from the opening 30 and the opening 30 may be filled with the additional bedding material.

In addition to the structural configuration of the leveling lifter described herein and any of the associated steps described above, methods of lifting and setting a precast concrete slab in place are described in greater detail. A method of lifting and leveling a precast concrete slab can comprise forming a precast concrete slab and embedding a threaded coupler within an opening of the concrete slab, wherein the opening runs through the entire depth of the slab. The method may further comprise releasably coupling a base to the concrete slab below the opening. The method may further comprise providing at least two protrusions on the base, the protrusions being set at a distance from one another or from the center of the base, the protrusions being configured to extend upwardly and substantially orthogonally from the base. The method may further comprise engaging a threaded actuator with the threaded coupler within the opening and lifting the precast slab by applying lifting force to the threaded actuator. The method may further comprise lifting and positioning the precast slab into a preexisting roadway. The method may further comprise operating the threaded actuator to thread the actuator down into the opening and against the base to thereby apply a force against the base and on the threaded coupler. The method may further comprise operating the actuator to generate a downward force to forcibly detach the plate from the bottom of the precast concrete slab and push the plate against a ground surface and to thereby generate a corresponding uplifting force to forcibly lift the concrete slab up and off the plate. The method may further comprise leveling the precast concrete slab to the height of the neighboring roadway. The method may further comprise filling the gaps between the precast concrete slab and the neighboring roadway, the neighboring precast concrete slabs, and the ground surface upon which the plate rests with additional bedding material. The method may further comprise removing the actuator and filling the opening with additional bedding material.

The components defining the above-described leveling lifter 10 may be formed of any of many different types of materials or combinations thereof that can readily be formed into shaped objects provided that the components selected are consistent with the intended operation of the leveling lifter 10 of the type disclosed herein. For example, and not limited thereto, the various components of the leveling lifter 10 may be formed of: rubbers (synthetic and/or natural) and/or other like materials; glasses (such as fiberglass) carbon-fiber, aramid-fiber, any combination thereof, and/or other like materials; polymers such as nylon or thermoplastics (such as ABS, Fluoropolymers, Polyacetal, Polyamide; Polycarbonate, Polyethylene, Polysulfone, and/or the like), thermosets (such as Epoxy, Phenolic Resin, Polyimide, Polyurethane, Silicone, and/or the like), any combination thereof, and/or other like materials; metals, such as zinc, magnesium, titanium, copper, iron, steel, carbon steel, alloy steel, tool steel, stainless steel, aluminum, any combination thereof, and/or other like materials; alloys, such as aluminum alloy, titanium alloy, magnesium alloy, copper alloy, any combination thereof, and/or other like materials; any other suitable material; and/or any combination thereof.

Furthermore, the components defining the above-described leveling lifter 10 may be purchased pre-manufactured or manufactured separately and then assembled together. However, any or all of the components may be manufactured simultaneously and integrally joined with one another. Manufacture of these components separately or simultaneously may involve extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, 3-D printing, and/or the like. If any of the components are manufactured separately, they may then be coupled with one another in any manner, such as with adhesive, a weld, a fastener (e.g. a bolt, a nut, a screw, a nail, a rivet, a pin, and/or the like), wiring, any combination thereof, and/or the like for example, depending on, among other considerations, the particular material forming the components. Other possible steps might include sand blasting, polishing, powder coating, zinc plating, anodizing, hard anodizing, and/or painting the components for example.

While this disclosure has been described in conjunction with the specific embodiments outlined above, it is evident that many alternatives, modifications and variations will be apparent to those skilled in the art. Accordingly, the preferred embodiments of the present disclosure as set forth above are intended to be illustrative, not limiting. Various changes may be made without departing from the spirit and scope of the present disclosure, as required by the following claims. The claims provide the scope of the coverage of the present disclosure and should not be limited to the specific examples provided herein.

What is claimed is:

1. A leveling lifter for a precast concrete slab comprising:

a coupler body embedded within an opening in a precast concrete slab, wherein the opening is open to a top and a bottom surface of the slab;

a base releasably coupled to the bottom surface of the slab and under the opening; and multiple projections that releasably couple the base to the slab, the projections being positioned on the base at a predetermined distance from the opening and configured to extend upward from the base substantially orthogonally into the slab, wherein the projections are configured to be released from at least one of: (a) the slab and (b) the base when the base is released from the bottom surface of the slab.

2. The leveling lifter of claim 1, wherein the coupler body extends through only a portion of the opening so as to be separated from the base.

3. The leveling lifter of claim 1, wherein the base defines a hole that aligns with the opening.

4. The leveling lifter of claim 1, wherein a portion of the projections is configured to break away from the base and to remain in the slab when the base is released from the bottom surface of the slab.

5. The leveling lifter of claim 1, further comprising legs extending from the coupler body into the precast concrete slab, the legs holding the coupler body away from the base.

6. The leveling lifter of claim 5, wherein each of the legs further comprises an enlarged foot configured to contact the base at a distance from the opening.

7. The leveling lifter of claim 5, wherein each of the legs further comprises a foot configured to contact the base at a distance from the opening, and wherein the base comprises a receptacle for the foot.

8. The leveling lifter of claim 1, wherein the projections are separated from the opening by cement before the base is released from the bottom surface of the slab.

9. The leveling lifter of claim 1, wherein the projections comprise a portion having a thinner diameter such that the projections are configured to break from the base when the base is decoupled from the slab.

10. A leveling lifter for a precast concrete slab, the leveling lifter comprising:

a body embedded in a concrete slab, the body having a coupler;

an actuator configured to engage the coupler within the slab; and a base releasably coupled to the concrete slab by multiple projections set at a distance from one another on the base, the projections being configured to detach from the concrete slab in degrees upon engagement of the base by the actuator, wherein the body extends from a position within the slab, wherein the body is embedded within an opening in the concrete slab, wherein the opening is open to a top and a bottom surface of the concrete slab, and wherein the projections are, before the base is released from the concrete slab, separated from the opening by concrete.

11. The leveling lifter of claim 10, wherein the body defines an internal opening through which a portion of the actuator is configured to pass, and wherein the body is separated from the base.

12. The leveling lifter of claim 11, wherein the base defines a hole that is aligned with the opening in the concrete slab.

13. The leveling lifter of claim 10, wherein the actuator is operable to engage the coupler and thereby exert a force on the base to detach the base from the concrete slab and to separate the projections from the base, the projections being configured to prevent the base from rotating with respect to the concrete slab as the base is released from the concrete slab.

14. The leveling lifter of claim 10, wherein the projections comprise cylindrical objects that are configured to be detached from the concrete slab.

15. The leveling lifter of claim 14, wherein the projections have a diameter and extend a length from the base, the length being at least four times the diameter.

16. The leveling lifter of claim 10, wherein the projections remain engaged with the concrete slab after the base has disengaged from the concrete slab.

17. The leveling lifter of claim 10, further comprising a duct coupled to the body and extending from the body to at least the top of the precast concrete slab, the duct and the body being axially aligned with one another.

18. A method of lifting and leveling a precast concrete slab, the method comprising:

embedding a threaded coupler within an opening of the concrete slab, wherein the opening runs through the entire depth of the slab;

releasably coupling a base to the concrete slab below the opening by providing at least two projections on the base, the projections being set at a distance from one another, the projections being configured to extend upwardly and substantially orthogonally from the base, with the projections being configured to be released from at least one of: (a) the concrete slab and (b) the base when the base is released from the bottom surface of the concrete slab;

threading the actuator down into the opening and engaging the threaded coupler; and operating the actuator to generate a downward force against the base to forcibly detach the base from the bottom of the precast concrete slab and to simultaneously generate a corresponding uplifting force to forcibly lift the concrete slab up and away from the base.

19. The method of claim 18, further comprising placing a hole in the base so that the hole is aligned with the opening.

20. The method of claim 18, further comprising disposing concrete between the opening and the projections before the concrete slab is forcibly lifted up and away from the base.

* * * * *